US010767336B2

(12) United States Patent
Angelov

(10) Patent No.: US 10,767,336 B2
(45) Date of Patent: Sep. 8, 2020

(54) PILE DRIVER AND METHOD OF DRIVING A PILE INTO AN UNDERWATER BED

(71) Applicant: VizionZ Engineering B.V., Rijswijk (NL)

(72) Inventor: Zdravko Angelov, The Hague (NL)

(73) Assignee: VIZIONZ ENGINEERING B.V., Rijswijk (NL)

( * ) Notice: Subject to any disclaimer, the term of this patent is extended or adjusted under 35 U.S.C. 154(b) by 0 days.

(21) Appl. No.: 16/332,844

(22) PCT Filed: Sep. 7, 2017

(86) PCT No.: PCT/NL2017/050585
§ 371 (c)(1),
(2) Date: Mar. 13, 2019

(87) PCT Pub. No.: WO2018/052286
PCT Pub. Date: Mar. 22, 2018

(65) Prior Publication Data

US 2019/0211524 A1 Jul. 11, 2019

(30) Foreign Application Priority Data

Sep. 14, 2016 (NL) ..... 2017462

(51) Int. Cl.
*E02D 13/04* (2006.01)
*E02D 7/20* (2006.01)
(Continued)

(52) U.S. Cl.
CPC ..... *E02D 13/04* (2013.01); *E02D 7/12* (2013.01); *E02D 7/14* (2013.01); *E02D 7/20* (2013.01);
(Continued)

(58) Field of Classification Search
CPC .. E02D 7/02; E02D 7/20; E02D 13/04; E02B 2017/0039; E02B 2017/0043; E02B 2017/0056
(Continued)

(56) References Cited

U.S. PATENT DOCUMENTS 3,001,592 A * 9/1961 Lucas ..... E21B 15/02 175/8
3,846,991 A * 11/1974 Wisotsky ..... E02B 17/02 405/228
(Continued)

FOREIGN PATENT DOCUMENTS

EP 1270824 A2 * 1/2003 ..... E02D 13/00
EP 2527539 A1 11/2012
(Continued)

OTHER PUBLICATIONS

International Search Report and Written Opinion for the International Patent Application No. PCT/NL2017/050585, dated Oct. 9, 2017.

*Primary Examiner* — Frederick L Lagman

(57) ABSTRACT

A pile driver configured to drive a pile into an underwater bed includes a floatable body with a pile guide configured to guide the pile in a downward direction, and an actuator that is fixed to the floatable body and that is configured to drive the pile from the floatable body into the underwater bed. A method of driving a pile into an underwater bed includes the steps of: positioning a floatable body; arranging a pile in a pile guide configured to guide said pile in a downward direction; and driving the pile from the floatable body into the underwater bed by an actuator that is fixed to the floatable body.

20 Claims, 9 Drawing Sheets

(51) Int. Cl.

| | |
|---|---|
| ***E02D 7/14*** | (2006.01) |
| ***E02D 7/12*** | (2006.01) |
| ***E02D 27/52*** | (2006.01) |
| *E02B 17/02* | (2006.01) |
| *E02B 17/00* | (2006.01) |

(52) U.S. Cl.
CPC ..... *E02D 27/52* (2013.01); *E02B 2017/0039* (2013.01); *E02D 2600/20* (2013.01)

(58) Field of Classification Search
USPC ..... 405/228
See application file for complete search history.

(56) References Cited

U.S. PATENT DOCUMENTS 3,950,954 A * 4/1976 Haug ..... E02D 7/20 405/228
3,958,647 A 5/1976 Chelminski
4,045,969 A * 9/1977 Jansz ..... B63B 35/44 405/228
4,063,599 A * 12/1977 Jansz ..... E02D 7/02 173/1
4,064,702 A * 12/1977 Jansz ..... E02D 7/00 405/228
4,102,147 A * 7/1978 Jansz ..... E02D 13/04 173/DIG. 1
2006/0051164 A1* 3/2006 Foo ..... E02B 17/0021 405/228
2008/0199259 A1* 8/2008 Cannon ..... E02D 7/10 405/232
2014/0023442 A1* 1/2014 Jung ..... E02D 13/06 405/232
2014/0169888 A1* 6/2014 Johansson ..... E02D 7/06 405/232
2016/0122968 A1* 5/2016 Jung ..... E02D 7/14 405/232

FOREIGN PATENT DOCUMENTS

JP 56085028 A * 7/1981 ..... E02D 13/02
JP 57146830 A * 9/1982 ..... E02D 7/16
JP 58138805 A * 8/1983 ..... E02D 13/02
JP S60250123 A 12/1985
JP 2003105762 * 4/2003
WO 0006834 A1 2/2000

* cited by examiner

PILE DRIVER AND METHOD OF DRIVING A PILE INTO AN UNDERWATER BED

This is a national stage application filed under 35 U.S.C. § 371 of pending international application PCT/NL2017/050585 filed Sep. 7, 2017, which claims priority to Netherlands Patent application NL 2017462, filed Sep. 14, 2016, the entirety of which applications are hereby incorporated by reference herein.

The present invention relates to pile driver and to a method of driving a pile into an underwater bed.

In offshore wind and oil and gas, large tubular members are used as a foundation for the support of the wind turbine or the top side of the installation. Typically, one or more elongated steel members are used as direct support in the soil (e.g. a monopile) on which the remainder of the structure is positioned. The installation of these piles is done by driving them into the soil.

In conventional pile driving, an impulse-like force is applied to the top end of the pile by the impact weight of a hammer. The resulting compressive stress wave propagates downwards, towards the tip of the pile. If resistance at the tip is high, such that the possible motion of the pile tip is close to zero, it will be reflected as a compressive stress wave back up the pile. If the tip resistance is very low, such that no force can be exerted from the pile to the soil, the reflection will be a tensile stress wave. In practice, the soil resistance will vary between these extremes. This variation, waves and the impacts of the hammer itself induce fatigue in the pile. The fluctuation of compressive and especially tensile stresses accelerate the growth of voids and micro cracks in the material of the pile. This significantly reduces its lifetime and/or requires a very large wall thickness.

In addition, impact pile driving imposes a limit on the speed of driving and sets high requirements on the pile as there is a limit on the maximum force of impact without damaging the top end of the pile and/or buckling the pile.

During such impact driving with a hammer, the pile is continuously loaded with alternating compressive and tensile stresses. This causes lateral vibrations of the outer surface of the pile, in turn resulting in the emission of sound pressure. As a consequence, noise-mitigation measures need to be applied during the pile driving in order to reduce these noise levels to an allowable level.

WO-A1-00/06834 discloses an underwater pile driving tool configured to drive a pile into an underwater bed, and is considered the closest prior art. Relative to this document at least the features of the characterizing portion of claim 1 are novel. U.S. Pat. No. 3,958,647, EP-A1-2 527 539 and JP S60 250123 are acknowledged as further prior art.

An object of the present invention is to provide a pile driver and a method, that is improved relative to the prior art, and wherein at least one of the above stated problems is obviated. In particular it is desired to reduce the negative effects on fatigue life, to increase the allowable driving forces on the pile, to reduce driving time and/or to reduce sound emissions especially when installing a foundation element in an underwater ground formation, Said object is achieved with the pile driver according to the invention, wherein said pile driver is configured to drive a pile into an underwater bed, said pile driver comprising:

- a floatable body with a pile guide configured to guide said pile in a downward direction; and
- an actuator that is fixed to the floatable body and that is configured to drive the pile from the floatable body into the underwater bed.

Contrary to a (free) falling hammer, the present invention comprises an actuator that is fixed to the floatable body. In this way, the pile may be displaced relative to the floatable body, wherein the weight of said floatable body is used to drive said pile into the underwater bed. This allows a very gradual driving of said pile into the underwater bed, which has some significant advantages:

- low impact on the top of the pile, i.e. where a conventional hammer impacts the pile;
- less dynamic loads while driving the pile into the soil, thereby reducing fatigue and allowing a smaller wall thickness of said pile;
- eliminating tensile stresses, thereby allowing the use of concrete piles that have a low tolerance for tension stresses; and
- possibly faster driving of a pile into the soil, because the driving force may be applied substantially continuously.

Said object is furthermore achieved with the method according to the invention, comprising the steps of:

- positioning a floatable body;
- arranging a pile in a pile guide configured to guide said pile in a downward direction; and
- driving said pile from the floatable body into the underwater bed by an actuator that is fixed to the floatable body.

According to a first aspect of the present invention, the pile driver comprises a floatable body with a pile guide configured to guide said pile in a downward direction and an actuator, fixed to the floatable body and configured to drive the pile from said floatable body into an underwater bed. Said pile guide is displaceable relative to the floatable body and is configured to provide motion compensation—preferably for both translational motion and rotational motion—thus, allowing the floatable body to remain in motion during driving without affecting the verticality and position of said pile. Said pile guide preferably comprises a positioning platform, a friction element and a positioning means configured to change the position of said positioning platform relative to the floatable body by sliding on said friction element providing motion compensation. Said pile actuator is preferably connected to said positioning platform (and not the floatable body directly), which allows the pile driver to drive the pile downwards and at the same time compensate for any lateral motion of the floatable body simultaneously.

In a preferred embodiment, said positioning means is configured with cylinders which have one chamber filled with a viscous fluid (e.g. oil) and a further chamber filled with a gas (e.g. air). This allows the cylinders to exercise the required large force in the action stroke (using the chamber with the high viscosity fluid) and go back to their initial position quickly (using the chamber with the gas).

In another embodiment, said positioning platform is configured in a star shape providing a better support for larger pile driving forces by distributing the loads evenly.

In yet another embodiment of the pile actuator, the driving of the pile is performed without said friction element. This eliminates one element from the pile actuator assembly, but requires the positioning means of the pile to be able to support the larger driving force.

According to a further preferred embodiment according to the invention, said pile guide further comprises a guide frame connected to said positioning frame and a gripper configured with a pivot. The gripper is configured around the pile and said pivot is configured to provide rotational freedom of motion of said pile relative to the positioning platform, which provides verticality of said pile in case the positioning platform is in motion during the driving of said pile for example when mounted on a ship or barge. Verticality of the pile is in particular the deviation of the pile, specifically the longitudinal axis of the pile, from the true vertical.

According to a further preferred embodiment, said actuator comprises a pulley assembly comprising a first set of pulleys arranged on said floatable body and/or a second set of pulleys arranged on said pile. Said pulley assembly further comprises a single tensioner and a force tool (e.g. a winch) replacing the impact blows from a conventional hammer by a gradual driving force on said pile that forces it into the soil relative to said floatable body.

The tensioner is configured to span between the top of the pile and a positioning platform. By gradually winding it up, the pile is forced into the soil in a gradual and continuous manner without sudden impacts by setting off from the positioning platform. The pile driver is thus configured to drive said pile without sudden impacts and has the benefit that the top flange of the pile, where usually the contact is made between a conventional hammer and the pile is better protected in the process of driving. It incurs no damage. In contrast, conventional pile driving causes the impact damage to the pile. The single tensioner, by means of the freely rotating pulleys of the pulley assembly, allows for self-adjustment and axial symmetry of the driving force on the pile. When the force tool pulls on said tensioner, the tensioner slides downwards and is guided over all said pulleys, thereby distributing the force equally.

In addition, this embodiment of the invention eliminates the fatigue from pile driving because there are no impacts on the pile and the force it is subjected to is constant with no dynamic effects. Thus a smaller wall thickness of the pile is possible or a longer lifetime during operation. The wall thickness of the pile is further reduced due to the reduced impact load.

This embodiment of the invention also eliminates the tension stress from pile driving as there is no reflected tensile wave propagation in the longitude of the pile due to impacts. Thus concrete piles can be used (which have low tolerance for tension stresses).

Furthermore, the elimination of impact on the pile also eliminates the noise of pile driving. Compared to the impact pile driving which generates significant noise in the ground, water and atmosphere with every blow of the hammer on the pile.

According to the invention, the pile is driven into the ground by applying a gradual driving force. This reduces the required driving force as the friction coefficient with the soil, that governs the reaction force, is lower once the pile is in motion and stays in motion—utilizing kinetic friction instead of static friction that can be 10% lower. Compared to impact driven movement with a stop-and-go behavior that always remains in the static friction range, the continuous movement of the pile according to the current invention also increases the speed of driving as there is no time lost between the individual blows of the conventional hammer.

In an alternative embodiment of the invention, the pile actuator comprises a brake near the second set of pulleys, which are configured near the top of the pile. Said brake is configured to restrain the speed of the tensioner going over the pulleys (either by means of all pulleys at the same time or by means of a specific set of said pulleys). In this embodiment, the second set of pulleys and said brake are configured as an aiming means for the pile driving direction. By activating said brake at the desired time and side of the pile, that specific side of the pile is pulled with a greater force from the force tool. This allows a correction to be done of the direction the pile is driven in, defined by the line between the attachment point of the second set of pulleys, the driving force rotation point, and the contact point of said pile in the underwater bed, the underwater bed rotation point. Additionally, in the case the second set of pulleys is configured at a significant distance from said pile gripper, a balance rotation point is created at the contact point of said gripper to the pile. This allows the pile driving direction to be rotated around the gripper and said pivot. By aligning said driving force rotation point, said underwater bed rotation point and said balance rotation point, the pile can be driven in any specified direction without creating unwanted lateral forces or moments.

In an alternative embodiment, the load on the set of pulleys connected to the positing platform is reduced by an additional vertical support, which is configured to support the vertical load from said tensioner directly. Said vertical support is kept in a vertical position, only under compression under the vertical load from driving of said actuator without bending, by a secondary positioning means (e.g. hydraulic cylinder). Said secondary positioning means may be configured to be attached either to the floatable body or said positioning platform.

In a further preferred embodiment, said second set of pulleys is arranged on a pile cover, arranged on the top of the pile, to which said tensioner is connected. In this way, the need for a gripper for applying the driving force on the pile is avoided, which would normally be connected somewhere in the middle of the pile to drive said pile in pieces. Applying said pile cover directly on the top of the pile reduces the time for driving by eliminating the steps of re-gripping said pile. In addition, there is no damage to the pile from the contact with the gripper and the power requirements for the pile driver are lower as a gripper relies on friction forces, which are much higher than the compression achieved with said pile cover.

Furthermore, said pile cover is much lighter than a conventional hammer, as it does not rely on its mass for driving, and thus there is no need of a crane for the placement of said pile cover. That is done already when the pile is on the deck of the floatable body and not at a later stage when the pile is already in an upright position.

In an alternative embodiment of the invention, the actuator comprises a hydraulic extender (e.g. an hydraulic cylinder) configured to converts it extension and pushing itself off the floatable body into a vertical driving force on the pile. Said extender is configured to be separate from the positioning means of said pile guide. In this configuration, the pile driver according to the invention benefits from the division of tasks over two subsystems—the pile actuator assembly configured with heavy cylinders which are configured with high capacity, but are inherently slow moving, and the pile guide assembly configured with quickly reacting cylinders, which are less powerful—to avoid the expensive requirement for heavy cylinders that are also quick.

In another preferred embodiment, the actuator further comprises a weight configured to be displaceable relative to said floatable body and which is configured to drive said pile with its gravitational force by being gradually lowered in a controlled manner, putting the pile tensioner under tension and pushing said pile into the underwater bed. Said weight is thus configured to store potential energy by being lifted, which can be easily released in a controlled manner on the pile to drive it in contract to a kinetic energy utilized by a conventional hammer.

In another embodiment of the pile actuator assembly, the driving of the pile is performed with a force from reverse acting hydraulic cylinders connected to the pile by a rod and a pivot point. When said cylinder pushes the rod upwards from the positioning platform said rod forces the pile downwards into the underwater bed.

The pile driver according to the invention may further comprise a pile booster assembly providing a boost in the driving performance for said pile and said pile driver. In, one of the preferred embodiments, said pile booster assembly comprises a substantially fluid tight seal positioned on said pile, a compressor (e.g. pump) and a pressurized fluid (e.g. sea water) enclosed in the inner space of said pile between the bottom end in the underwater bed and the pile cover on the top of the pile. Said compressor is configured to pressurize said fluid to a desired pressure level. The pressurization of said fluid inside the pile increases the allowable buckling stress of the pile allowing it to handle a larger pile driving force and thus be driven faster. Boosting the pile performance in this way also allows said pile to be driven as a whole, without having to grip it at short intermediary sections, and without buckling.

Furthermore, said pile booster assembly also provides a boost in the performance of the pile driver according to the invention by means of said pressurized fluid inside the pile. Said fluid inside said pile is configured to reduce the friction forces between the inside surface of said pile and the soil by increasing the pore pressure in the soil and creating local soil liquefaction. Thus, the resistance during pile driving is reduced significantly allowing for an increased speed of driving and reduced stresses in the pile due to the lower driving force required.

In another embodiment of said pile booster assembly, said fluid inside the pile is pressurized air. In this embodiment, said pile cover and said fluid tight seal close off said pile in an air-tight way entrapping the air inside. While the pile actuator assembly presses said pile into the underwater bed, the volume on the inside of the pile between the soil and said pile cover is reduced and thus the pressure of the entrapped air is increased. The pile driver is thus configured to increase the buckling strength of the pile by itself, eliminating the need for a compressor.

In a further embodiment of the invention, the pile booster assembly further comprises a pressure relief valve which connects the fluid inside said pile to the outside and which is configured to either maintain a certain pressure, dropping the fluid pressure by releasing excess fluid or allowing pressure inside the pile to build up. Said pressure relief valve is configured to close during the driving of the pile, but open again when the pressure of the inside fluid increases too much due to the fluid volume inside said pile becoming smaller. This allows the inside pressure of said pile booster assembly to be maintained from start to finish of the pile driving.

Said pressure relief valve is further configured to be able to remain closed for a longer period of time and allow the compressor to build up an inside pressure higher than the friction force between said pile and soil, as a result, pushing said pile upwards. In this way, said pile driver is configured to reverse the pile being driven and correct any inclination errors regarding the verticality requirements on the pile or completely decommission said pile, also a long period after said pile has been driven.

In a further embodiment of the invention, said pile driver further comprises a control system configured to perform the most optimal pile driving operation in terms of requirements (e.g. pile verticality, speed of driving) by controlling the operation of the pile driver based on input from sensors. Said control system comprises input sensors for the measurement and monitoring of at least one of: a force in the pile actuator, a stress in the pile, a penetration level of the pile, a noise level during driving, an orientation of the pile and floatable body (e.g. inclination sensors) or a fluid pressure in the pile. Said control system is further configured to control at least one of the actuator, the compressor, the pressure relief valve or the displacement of the pile guide relative to the floatable body. Said control system further comprises a control unit configured to monitor several of the pile driving parameters and actuate the pile guide, actuator and pile booster assembly accordingly, either based on a predefined behavior model or based on real-time input from an operator.

In another embodiment, the pile actuator assembly is configured to drive the pile with a force from a reverse acting hydraulic cylinders actuated by the legs of a jack-up barge. In this embodiment, the pile is connected to the legs of the jack-up barge from which the driving is done by a rod and a pivot point. When the barge is jacked up it forces the other end of the rod downwards and the thus the pile is forced into the soil. In this embodiment, the existing machinery on an installation vessel is also employed to perform the pile driving, thus, saving on the cost of dedicated pile driving equipment.

A method for driving a pile into an underwater bed is also disclosed. The method is suitable for use during an installation of the pile with the pile driver described above. According to a preferred embodiment, the step of driving said pile from the floatable body into the underwater bed comprises displacing said pile relative to the floatable body and using at least the weight of said floatable body to drive said pile into the underwater bed.

Preferred embodiments are the subject of the dependent claims.

In the following description preferred embodiments of the present invention are further elucidated with reference to the drawing, in which.

Figure 1:
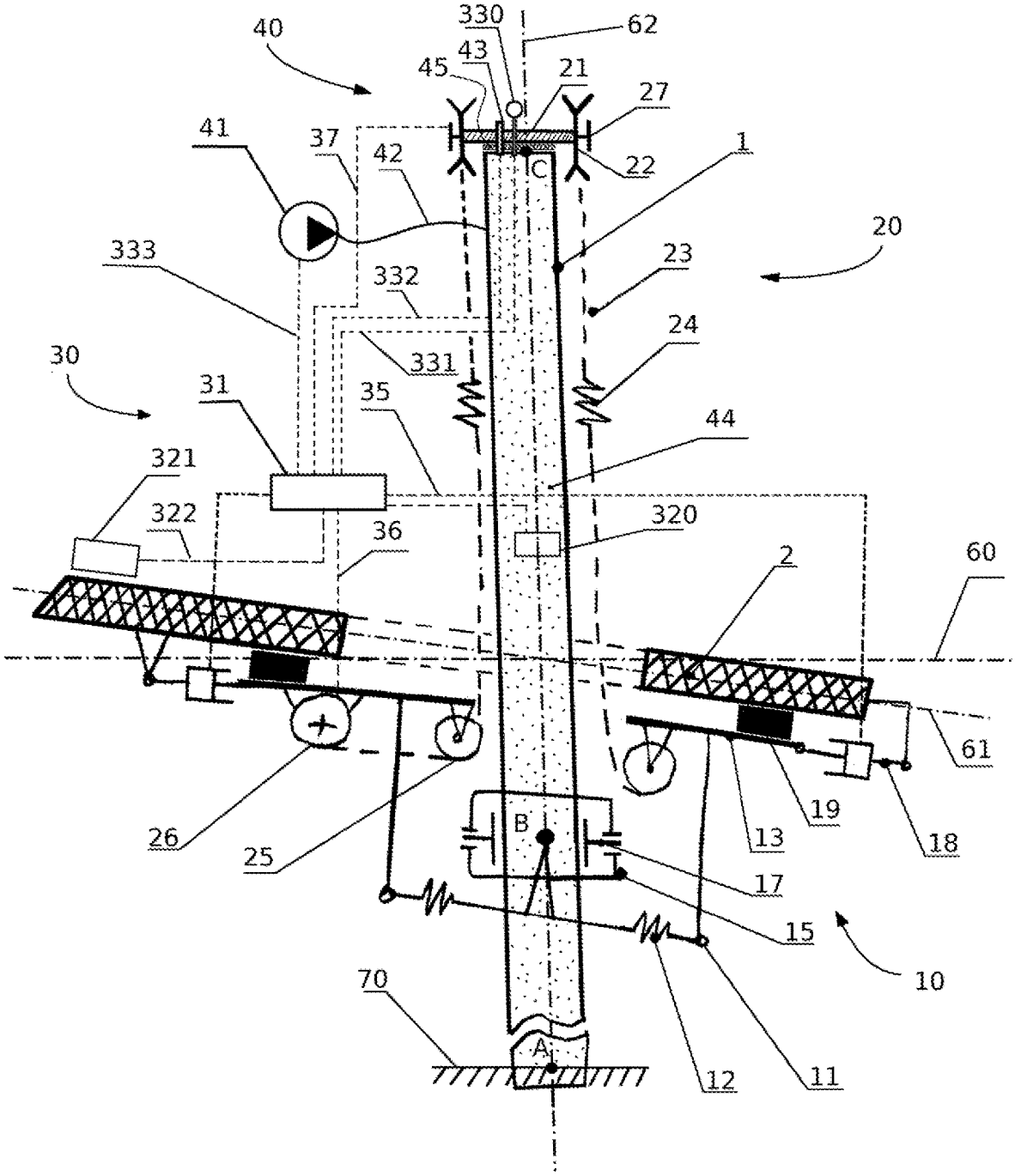
FIG. 1 is a schematic cross sectional view of the first preferred embodiment of the pile driver according to the disclosure.

FIG. 1 shows a pile driver embodiment according to the present invention, which comprises a pile guide assembly 10, connecting a pile 1 to a floatable body 2, a pile actuator assembly 20 and a pile booster assembly 40 attached to the top end of the pile 1 and a pile driving control system 30 connected to all said assemblies. The pile driver is configured to drive the pile 1 into an underwater bed 70 with a gradual driving force by the pile actuator assembly 20 while keeping the pile 1 vertical with the pile guide assembly 10 within desired tolerances defined on the pile midline 62.

In this preferred embodiment, the pile guide assembly 10 is configured to keep the pile 1 both vertical and in the same absolute position in the horizontal plane during driving while the floatable body 2 (e.g. sea vessel) is in motion—either translational or rotational motion (by waves or any other external influence). The pile guide assembly 10 provides motion compensation for the rotational motion (in one or more axis) of the floatable body horizontal 61 relative to the absolute horizon 60 and for the translational movement (in one or more axis) of the balance rotation point B in the pile 1 relative to the rotation point A in the underwater bed 70. Aligning the balance rotation point B above the underwater bed rotation point A keeps the pile 1 vertical. At the same time, the pile actuator assembly 20 is configured to keep the driving force rotation point C in vertical alignment also with the underwater bed rotation point A, minimizing the arising of any horizontal forces on the pile 1 from the driving.

The pile guide assembly 10 comprises a pile guide frame 11 with a positioning platform 13 at one end and a pivot 15 at the other end, which is equipped with a gripper 17 that grips the pile 1. The positioning platform 13 is in contact with the floatable body 2 and is configured to slide relative to it by means of the intermediate friction element 19. The positioning platform 13 is attached to the floatable body 2 by a positioning means 18 (e.g. hydraulic cylinder) allowing to force the positioning platform 13 to slide relative to the floatable body 2 with a desired force and in a desired direction, in this way absorbing any translational motion of the floatable body 2 relative to the pile 1 and keeping pile 1 in the same position. The pivot 15 is configured to rotate in all axis while the pile 1 is held by the gripper 17 allowing for any rotation of floatable body horizontal 61 to be absorbed and keeping the pile 1 vertical. The pile guide frame 11 and the pivot 15 are optionally connected by an elastic element 12 providing a dampened translation of the motion forces between the positioning platform 13 and the pile 1.

The pile actuator assembly 20 comprises a first set of pulleys 25, near the lower end of the pile 1, and a second set of pulleys 22, near the top end of the pile 1, that are interconnected by a tensioner 23 (e.g. steel cable). The first set of pulleys 25 is connected to the positioning platform 13 and the second set of pulleys 22 is connected to a pile cover 21, which is positioned on the top of the pile 1. The first set of pulleys 25 and the second set of pulleys 22 preferably, but not necessarily, comprise an equal number of individual pulleys that are positioned in a plane symmetrical configuration around the circumference of the pile 1. The tensioner 23 is laced through the pulleys in an alternating sequence—from one pulley of the first set 25, along the length of the pile 1 and into one pulley of the second set 22 and back to the first set of pulleys 25—and ends up in a force tool 26 (e.g. winch) that is configured to pull it through all the pulleys and wind the tensioner 23 up. By winding up the tensioner 23, the pile cover 21 is pulled towards the positioning platform 13 with a gradual and plane symmetrical force. This forces the pile 1 in a downward direction into the underwater bed 70, creating an upwards resistance force, and pushes the positioning platform 13 upwards against the floatable body 2, creating a downward reaction force. Since the weight of the floatable body 2 is larger than the resistance force of the pile 1 in the underwater body 70, the pile 1 is driven into the underwater bed 70 with a gradual force regulated by the force tool 26 to the desired depth. The first set of pulleys 25 are configured, by means of their rotation, to accommodate for any changes in the inclination of the positioning platform 13 relative to the pile cover 21 and keeping the force from the tensioner 23 always vertical. Thus, in this embodiment, the first set of pulleys 25 and the second set of pulleys 22 enable the driving force rotation point C to be in vertical alignment with the balance rotation point B.

The pile cover 21 further comprises an optional brake 27 that can restrain the speed of the tensioner 23 going through the second set of pulleys 22 by limiting their rotational speed either individually or as a group. This allows adjustments to be made in the axial symmetry of the forces applied on the pile cover 21 in the longitudinal direction of the pile 1. In case one side of the pile cover 21 is needed to exercise a larger downwards force than the rest (e.g. to correct for non-verticality), the brake 27 on that side is activated creating a fixed point of force application increasing the driving force on that side of the pile cover 21.

In addition, the tensioner 23 also optionally comprises an elastic element 24 configured to absorb quick and/or fluctuating changes in the length of the tensioner 23 without directly increasing the load on the force tool 26 or the pile 1.

The pile booster assembly 40 comprises a fluid 44 that fills the pile 1 between the pile cover 21 and the underwater bed 70. The pile booster assembly 40 further comprises a seal 45, which is positioned between the pile cover 21 and the pile 1 and is configured to be substantially fluid tight allowing the fluid 44 to be pressurized to a desired level. Preferably, the contact layer between the pile 1 and the underwater bed 70 is also configured to be fluid tight, depending on the soil type. To the pile 1 is connected a compressor 41, by a pressurization line 42, that is configured to pump fluid under pressure inside the pile 1 from the outside environment (not shown). The pile cover 21 comprises a pressure relief valve 43 that allows the fluid 44 to escape from the pile 1 when a certain pressure is reached.

The pile booster assembly 40 is configured to enable for a larger pile driving force by increasing the allowable buckling stress of the pile 1 by an increased internal pressure of the fluid 44. When the support from the pressure of the fluid 44 inside the pile is not needed any more, or has reached the desired magnitude, the pressure relief valve 43 is opened and the excess pressure of the fluid 44 is released.

The pile driving control system 30 comprises a controller 31 and the measurement units for pile position 320, floatable body position 321 and fluid pressure 330. The controller 31 is configured to receive data from and is connected to the floatable body position measurement unit 321 by the position data input line 322, to the fluid pressure measurement unit 330 by the pressure data input line 331 and to the pile position measurement unit 320 and floatable body position measurement unit 321 by the position control line 35. Furthermore, the controller 31 is configured to control and is connected to the pressure relief valve 43 by the valve control line 332, to the compressor 41 by the compressor control line 333, to the brake 27 by the brake control line 37, to the force tool 26 by the force control line 36 and to the positioning means 18 by the position control line 35.

Figure 2:
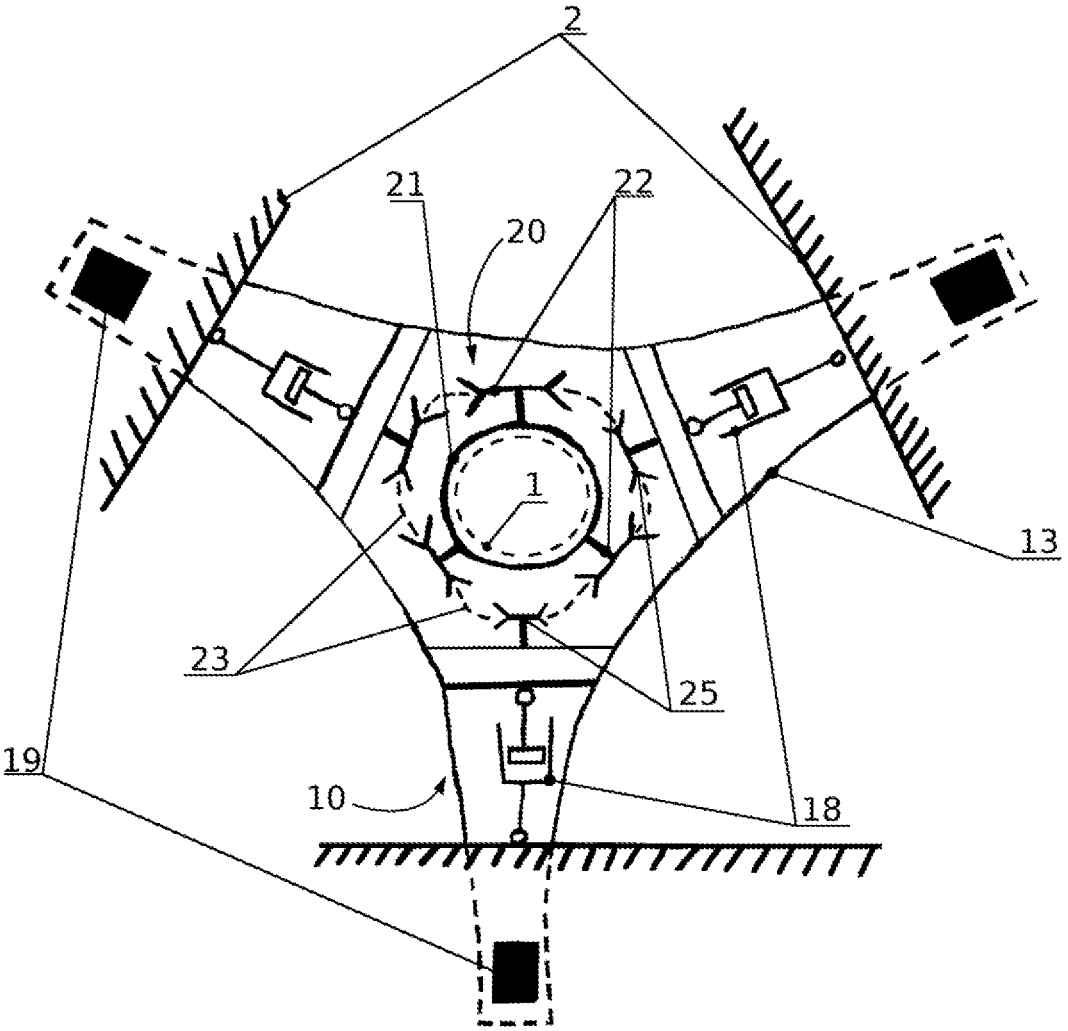
FIG. 2 shows a top plane view of the first preferred embodiment of the pile guide assembly and the pile actuator assembly.

FIG. 2 shows a top plane view of the first preferred embodiment of the pile guide assembly 10 and the pile actuator assembly 20. On the pile 1 is positioned the pile cover 21 with the pulleys of the second set 22 attached in a symmetrical configuration. From the second set of pulleys 22 extends the tensioner 23 downwards to the first set of pulleys 25, which are connected to the positioning platform 13. In this preferred embodiment the positioning platform 13 is star shaped for a more optimal distribution of the forces created during the driving of the pile 1. To the positioning platform 13 are connected the friction elements 19 which are configured to slide against the bottom part of the floatable body 2. The floatable body is further connected to the positioning platform 13 by the positioning means 18.

Figure 3:
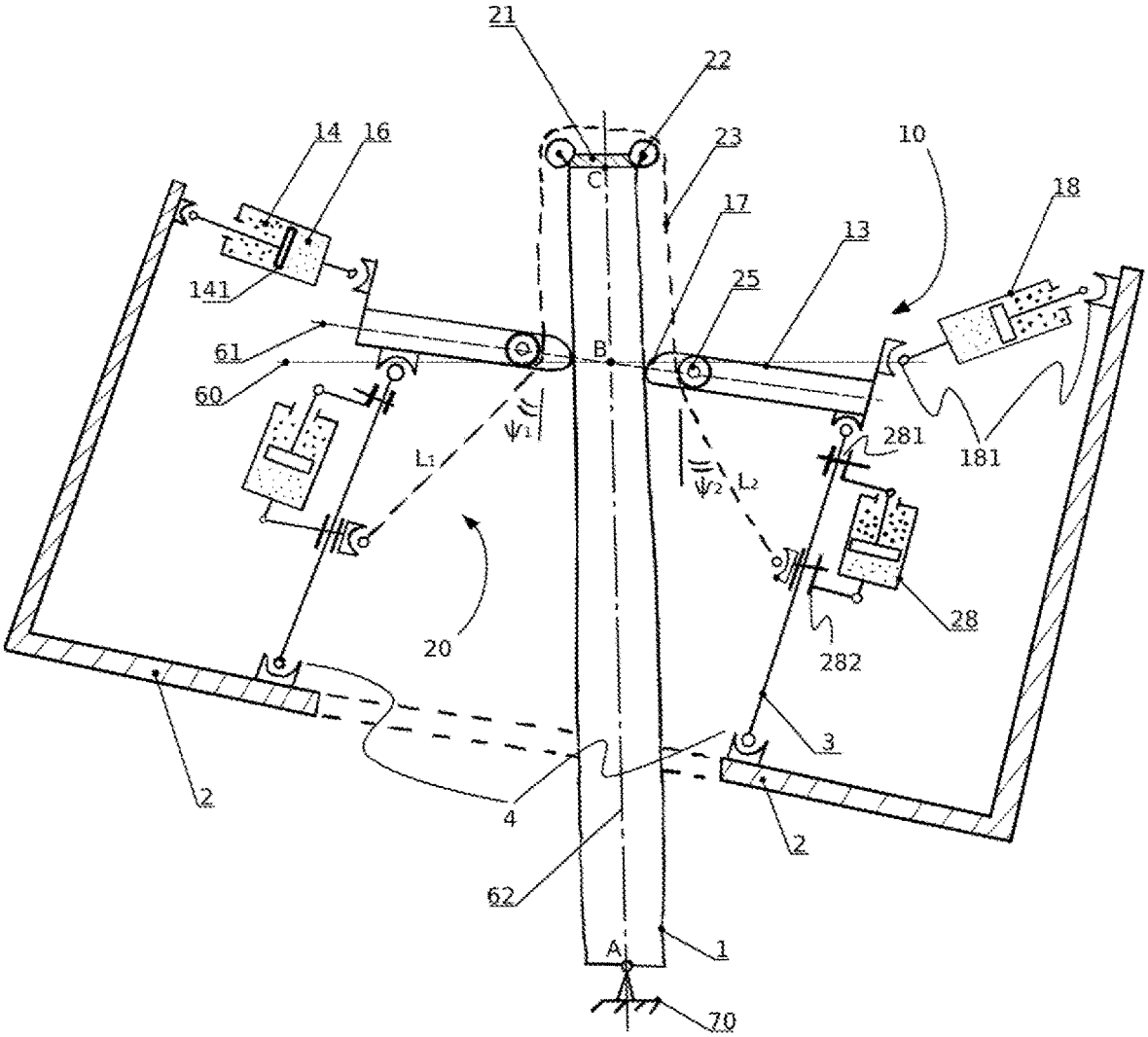
FIG. 3 shows a cross sectional view of an alternative embodiment of the pile guide assembly and the pile actuator assembly of the pile driver.

FIG. 3 shows one of several preferred embodiments of the pile guide assembly 10 and the pile actuator assembly 20 of the pile driver according to the invention. The pile 1, with a pile midline 62, is positioned on the underwater bed 70 at the underwater bed rotation point A where it is to be driven. The floatable body 2, with a floatable body horizon 61, is positioned around the pile 1 with the pile guide assembly 10 and pile actuator assembly 20 attached to it.

The pile guide assembly 10 comprises the positioning platform 13, the positioning means 18 and a vertical support 3. The positioning platform 13 comprises the gripper 17, which grips the pile 1, and is configured to move in a horizontal direction, parallel to the horizon 60, but not in vertical direction.

In the horizontal direction, the positioning platform 13 is connected to the floatable body 2 by the positioning means 18 with ball joints 181 at the connection points. The positioning means 18 comprises chambers with a first fluid 14 and a second fluid 16 and a piston 141 that separates them. The chambers of the first fluid 14 and second fluid 16 are configured to expand and contract to regulate the position of the piston 141 and the attached positioning platform 13 in the horizontal direction. The first fluid 14 is preferably with high viscosity (e.g. oil) and the second fluid 16 is preferably with low viscosity (e.g. gas), which enables the push force to be large, while the recovery to position (where no force is required) to be executed with speed.

In the vertical direction, the positioning platform 13 is connected to the floatable body 2 by the rigid vertical support 3 with ball joints 4 at the connection points, which are configured to allow rotation due to the horizontal shifting of the positioning platform 13, but no vertical movement, allowing the positioning platform 13 to be supported on the floatable body 2.

The pile actuator assembly 20 comprises the pile cover 21 with the attached second set of pulleys 22, the first set of pulleys 25, the tensioner 23 and an extender 28. The pile cover 21 is positioned on the top of the pile 1 and is equipped with the symmetrically positioned second set of pulleys 22. The tensioner 23 connects the second set of pulleys 22 to the extender 28 by passing over the first set of pulleys 25. The first set off pulleys 25 is configured to guide the tensioner 23 from a vertical direction, coming from the pile cover 21, to an angular direction towards the extender 28 to the side. Preferably, the product of length $L_1$ and angle $\psi_1$ is kept equal to the product of the length $L_2$ and angle $\psi_2$ in order to balance the resulting horizontal forces along the horizon 60 on the first set of pulleys 25 and positioning platform 13. This balance is performed in combination with the corrections by the positioning means 18 allowing for the most optimal total correction to be achieved by the most efficient combination of reaction speed and load capacity between the positioning means 18 and the extender 28.

The extender 28 is attached to the rigid vertical support 3 with movable connections 281 and 282 and is configured to extend and shorten the distance between the movable connections 281 and 282 (e.g. by a hydraulic cylinder). The end of the tensioner 23 is attached to the movable connection 282 of the extender 28 in such a way that when the extender 28 extends the tensioner 23 is pulled downwards.

The movable connections 281 and 282 are configured to be easily released from the vertical support 3, slide along its length and be fixed into position again. The extender 28 is thus configured to create a downwards force and also reposition itself along the length of the vertical support 3. By fixing the upper movable connection 281 to the vertical support 3 and releasing the lower movable connection 282, the extender 28 is able to push downwards against the vertical support 3 when it is extended. By fixing the lower movable connection 282 to the vertical support 3 and releasing the upper movable connection 281, the extender 28 is able to reposition itself by contracting. Repeating these extending and contracting steps, the pile cover 21 is pulled downwards with a gradual force by the extender 28 and tensioner 23. This forces the pile 1 in a downward direction and into the underwater bed 70, creating an upwards resistance force, and pushes the vertical support 3 upwards pulling on the floatable body 2, creating a downward reaction force. Since the weight of the floatable body 2 is larger than the resistance force of the pile 1 in the underwater body 70, the pile 1 is pushed into the underwater bed 70 with a gradual force regulated by the extender 28.

Figure 4:
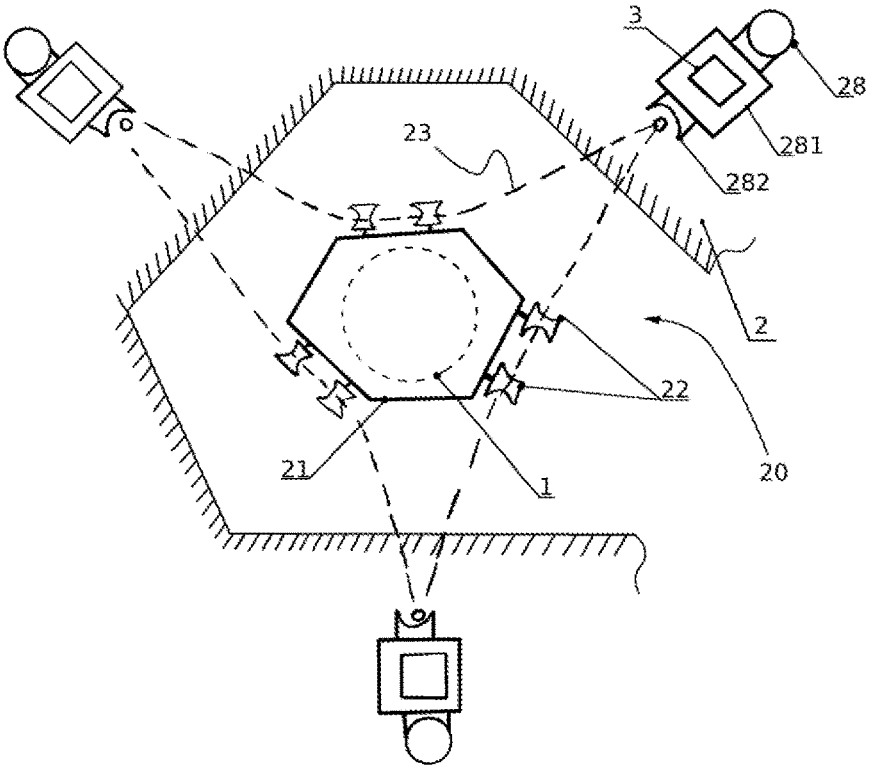
FIG. 4 shows a top view of the pile actuator assembly from FIG. 3.

FIG. 4 shows a top view of the pile actuator assembly 20 from FIG. 3. The floatable body 2 supports the vertical supports 3 to which the extender 28 is connected by the upper movable connection 281 and the lower movable connection 282. In the gap in the floatable body 2 is positioned the pile 1. On the pile 1 is positioned the pile cover 21 with attached second set of pulleys 22. The tensioner 23 is stretched over the second set of pulleys 22 downwards to the lower movable connection 282.

Figure 5:
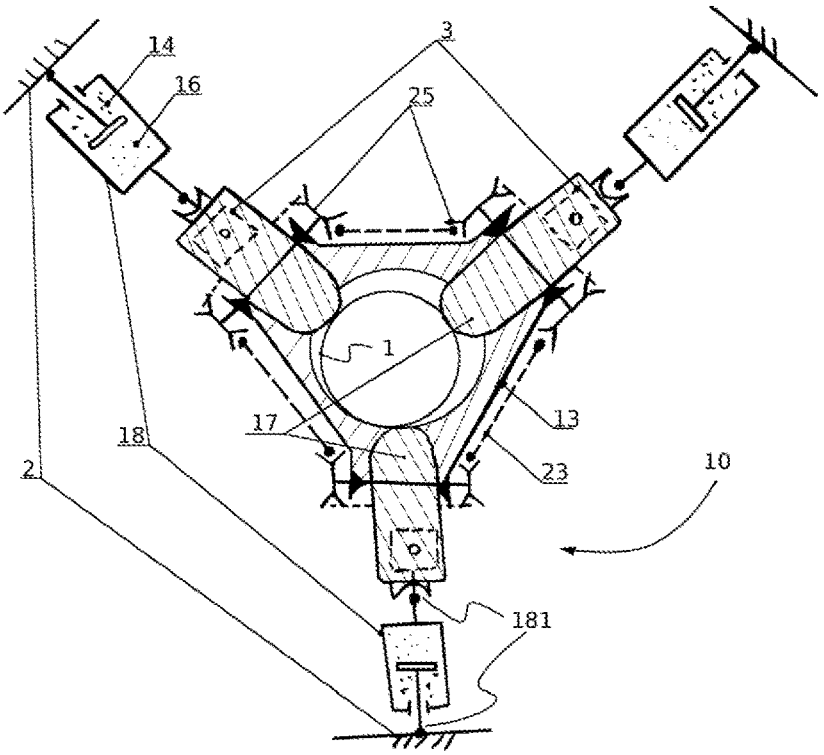
FIG. 5 shows a cross-sectional view of the pile guide assembly from FIG. 3 at the level of the horizon.

FIG. 5 shows a cross-sectional view of the pile guide assembly 10 from FIG. 3 at the level of the horizon 60. The pile 1 is positioned in the gap for the floatable platform 2 and is guided in the desired position relative to it though the positioning platform 13 and the attached gripper 17 which grips the pile 1. The positioning platform 13 is attached to the floatable body 2 by the positioning means 18 and the ball joints 181 at the connection points. The positioning means 18 comprises chambers with a first fluid 14 and a second fluid 16. The horizontal position of the positioning platform 13 is adjusted by extending or contracting the positioning means 18 from all sides in a coordinated manner.

The positioning platform 13 is supported in the vertical direction on the floatable body 2 by the vertical support 3. The first set of pulleys 25 is attached around the positioning platform 13 stretching the tensioner 23 coming from the top towards its attachment point on the vertical support 3.

Figure 6:
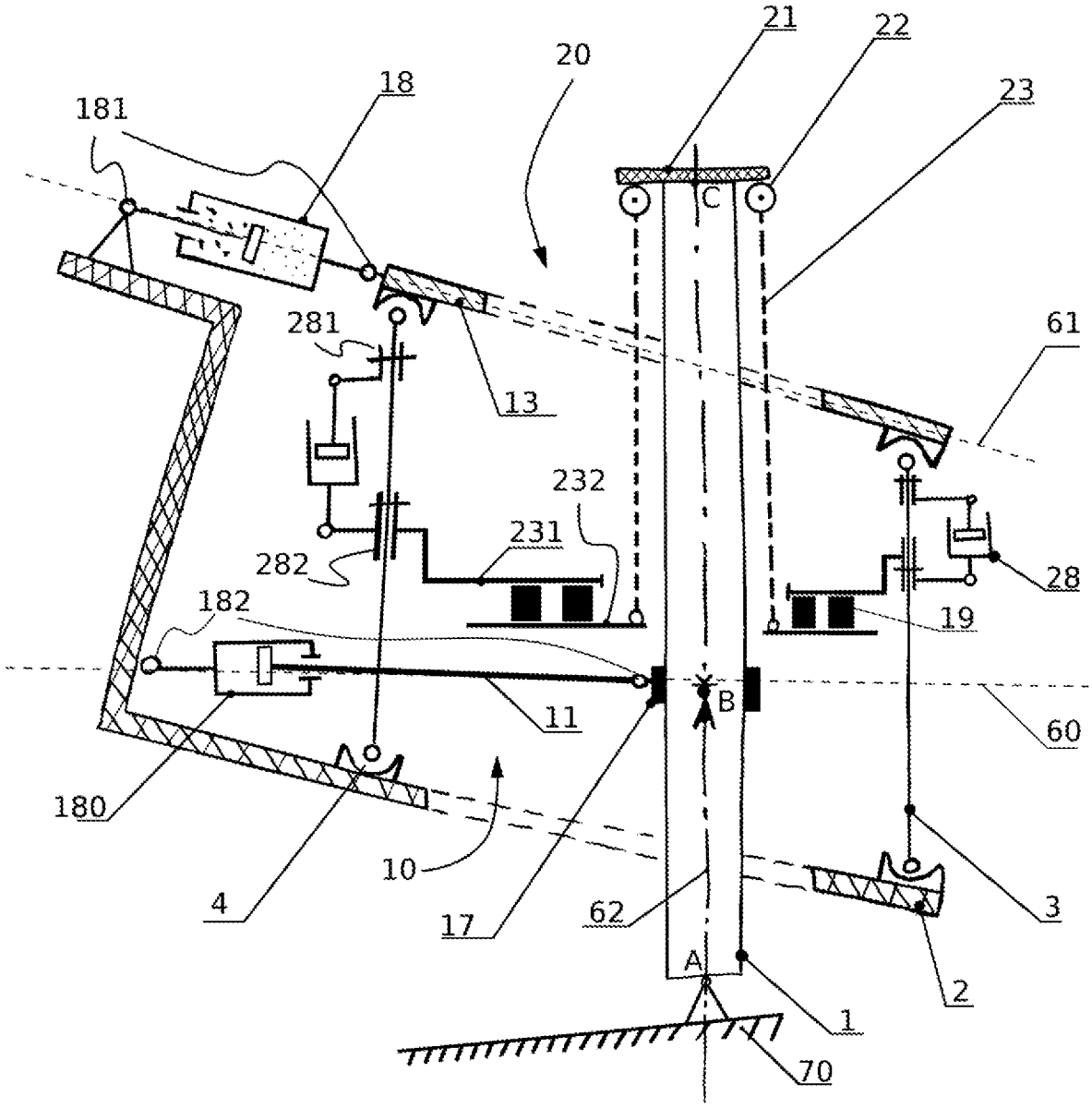
FIG. 6 shows an alternative embodiment of the pile driver, wherein the pile actuator assembly employs vertical supports and an extender.

FIG. 6 shows an alternative embodiment of the pile driver according to the invention comprising the pile guide assembly 10 and the pile actuator assembly 20 positioned on the pile 1. The pile 1, with the pile midline 62, is positioned in a gap of the floatable body 2 and resting on the underwater bed 70.

The pile actuator assembly 20 comprises the positioning platform 13 which is supported in a vertical direction and from underneath by the rigid vertical support 3. The vertical support 3 is connected to the floatable body 2 by the ball joint 4, which allows for the rotation of the upper part of the vertical support 3 and thus for the horizontal movement of the positioning platform 13 along the horizon 60. The vertical support 3 is kept vertical in relation to the horizon 60, and in parallel to the pile midline 62, by the positioning means 18 (only one side shown) which connects the positioning platform 13 to the floatable body 2 by the ball joints 181. By extending and contracting the positioning means 18 the positioning platform 13 is moved along the horizontal plane 60.

The pile actuator assembly 20 further comprises the extender 28 which is connected to the rigid vertical support 3 by the upper movable connection 281 and the lower movable connection 282. To the lower movable connection is connected a driving support element 231 which limits the upward motion of a second driving support element 232 by the friction element 19 in between. To the second driving support element 232 is connected the tensioner 23 which extends upwards to the pile cover 21. The pile cover 21 is placed on the top of the pile 1 and supports the second set of pulleys 22 through which the top part of the tensioner 23 is laced. The extender 28 forces the pile 1 into the underwater bed 70 by extending and pushing the lower movable connection 282 downwards, which puts the tensioner 23 under tension through the first driving support element 231 and the second driving support element 232, to finally pull the pile cover 21 downwards.

The pile guide assembly 10 comprises the pile guide frame 11 and a secondary positioning means 180. The pile guide frame 11 is fitted with a gripper 17 on the one end that grips the pile 1. On the other end, the pile guide frame 11 is connected to the secondary positioning means 180 (e.g. hydraulic cylinder) of which several are symmetrically placed (only one shown) in the circumference of the pile. The secondary positioning means 180 is connected to the floatable body 2 by the positioning ball joint 182. This enables the positioning of the pile 1 by means of the gripper 17 by the secondary positioning means 182, which is configured to push and pull the pile guide frame 11 against the floatable body 2.

Figure 7:
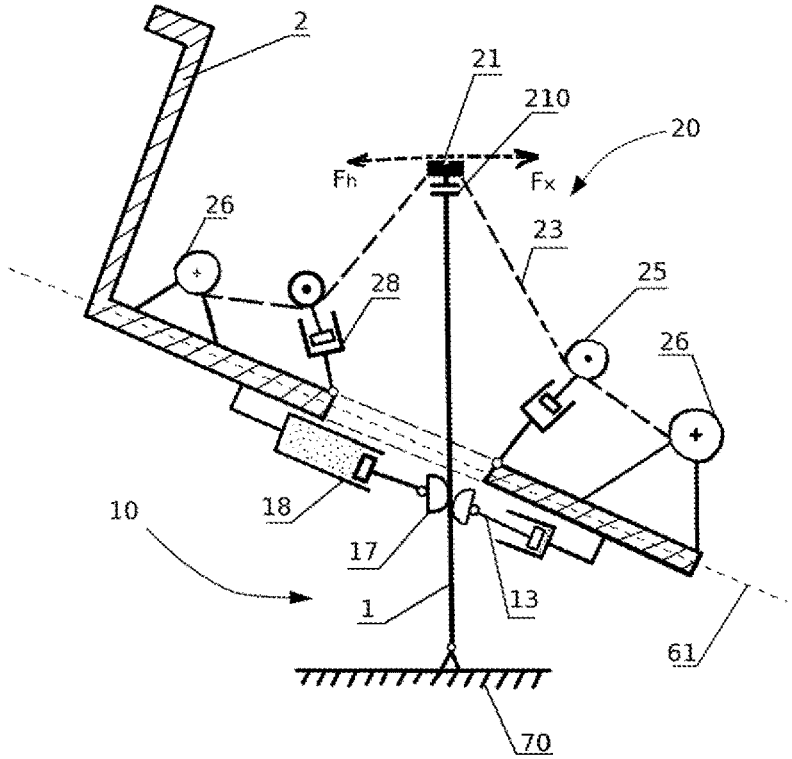
FIG. 7 shows a further alternative embodiment of the pile actuator assembly without the use of pulleys to drive the pile.

FIG. 7 shows an alternative embodiment of the pile actuator assembly 20 without the use of pulleys to drive the pile 1. The pile 1 is positioned on the underwater bed 70 from the floatable body 2 by the pile guide assembly 10 and ready to be driven by the pile actuator assembly 20. The pile guide assembly 10 keeps the pile 1 vertical with the positioning platform 13 equipped with the gripper 17 and the positioning means 18 attached to the floatable body 2.

The pile actuator assembly 20 comprises the force tool 26 attached to the floatable body 2 and the tensioner 23 which spans over the top of the pile 1 and is attached directly to the pile cover 21 without any pulleys. The downwards driving force of the pile actuator assembly 20 is directed by the extender 28 attached between the floatable body 2 and the tensioner 23 through the first set of pulleys 25. By extending or contracting the extender 28, the position of bottom end of the tensioner 23 can be regulated and thus the horizontal force components Fx and Fh acting on the top end of the pile 1. Since the top end of the tensioner 23 is fixed to the pile cover 21 these changes in direction by the extender 28 is used to minimize the horizontal forces that can take the pile 1 out of its vertical position driving.

In addition, the pile actuator assembly 20 comprises a torsion element 210 positioned between the pile 1 and the pile cover 21. The torsion element 210, comprises two contact surfaces, one to the pile 1 and one to the pile cover 21, and is configured to allow a rotation between said two surfaces, thus allowing the pile 1 to rotate in around its axis relative to the pile cover 21 and floatable body 2 to which it is connected by means of the tensioner 23. Thus, in case the floatable body 2 and the pile actuator assembly 20 are rotated (e.g. by the current or waves) the contact to the pile 1 is kept constant and no friction or torsion is created.

Figure 8:
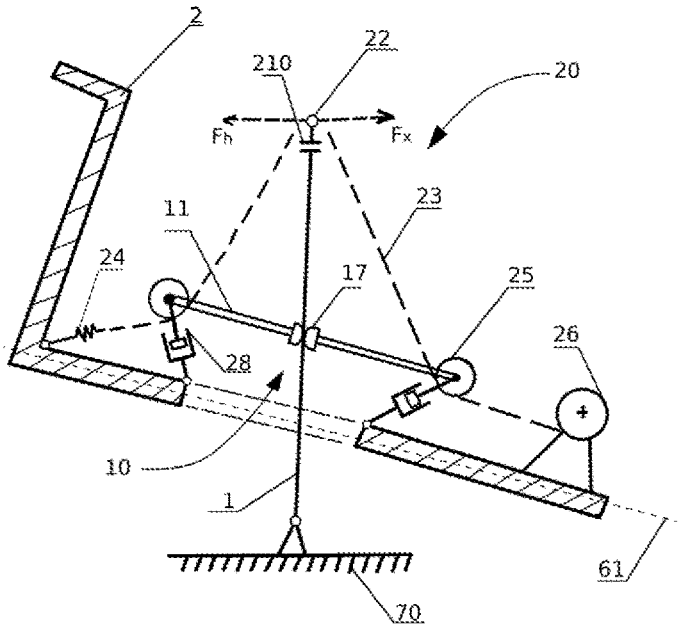
FIG. 8 shows an alternative embodiment of the pile actuator assembly, wherein the downward driving force is also used for tightening of the grip on the pile.

FIG. 8 shows an alternative embodiment of the pile actuator assembly 20 where the downward driving force is also used for tightening of the grip on the pile 1. The pile 1 is configured on the underwater bed 70 by the pile guide assembly 10 and is pushed downwards by the pile actuator assembly 20. The pile actuator assembly 20 comprises the force tool 26, attached to the floatable body 2 and is configured to pull on the one end of the tensioner 23. The other end of the tensioner 23 is guided over the top end of the pile 1, through the second set of pulleys 22, and is fastened to the floatable body 2 by an intermediary elastic element 24. The tensioner 23 is directed through the first set of pulleys 25, which are attached to the floatable body 2 by means of the extender 28, and to the pile guide frame 11. The pile guide frame 11 keeps in contact with the pile 1 by means of the gripper 17. Thus, the pile guide frame 11 is configured between the first set of pulleys 25 such that the force on the gripper 17 can be tightened or loosened by changing the force in the force tool 26 and/or the position of the extender 28, eliminating in this way the need for a separate gripped actuator.

Figure 9:
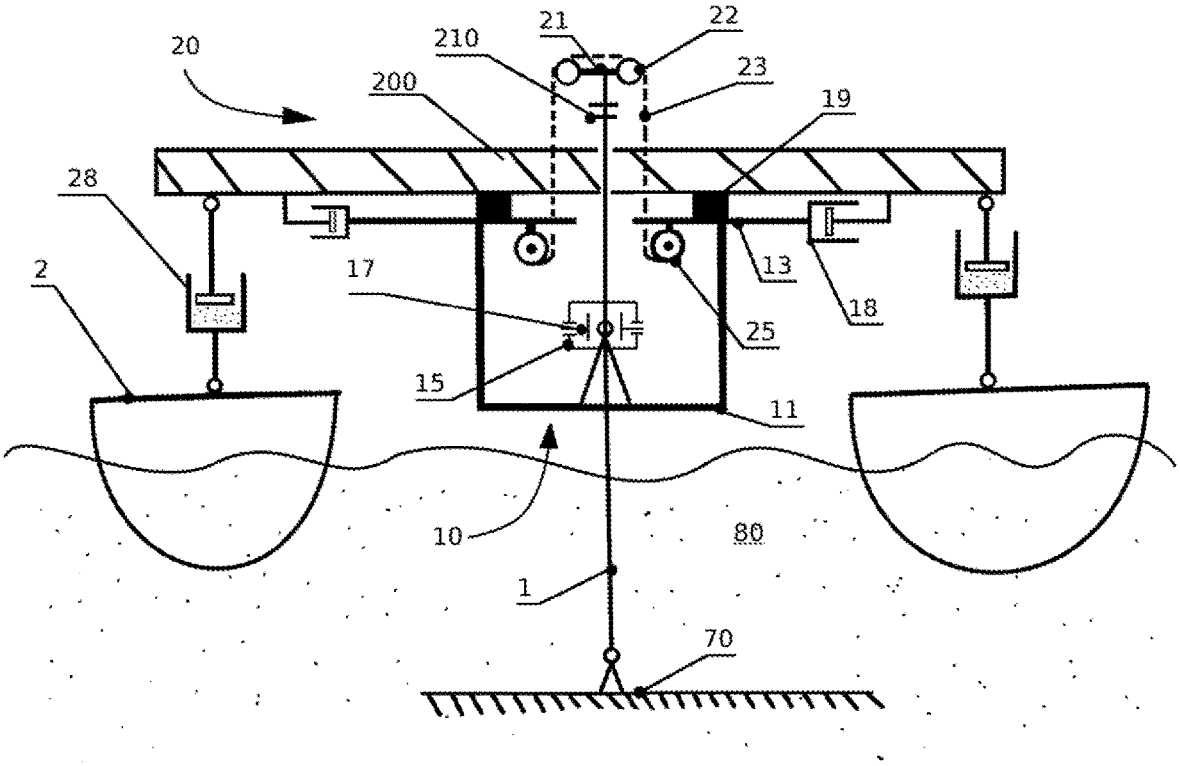
FIG. 9 shows an alternative embodiment of the pile driver, wherein the pile actuator assembly drives the pile by using the vertical force of a weight.

FIG. 9 shows an alternative embodiment of the pile driver where the pile actuator assembly 20 drives the pile 1 into the underwater bed 70 by using the vertical force of a weight 200. In this embodiment, the pile 1 is configured on the underwater bed 70 in the body of water 80. In the body of water 80, the floatable body 2 is positioned close to the pile 1 and supports the pile actuator assembly 20 and pile guide assembly 10 above the pile 1. The floatable body 2 may comprise several separate units that may be interconnected and each supporting part of the pile actuator assembly 20 and the pile guide assembly 10.

The pile actuator assembly 20 comprises a weight 200 supported on the floatable body 2 by the extenders 28. The extenders 28 are configured with sufficient capacity to lower and raise the weight 200 in a controlled manner and the floatable body 2 is configured with sufficient buoyancy to support the weight 200 without sinking. Under the weight 200 is attached the positioning platform 13 which is configured to slide along the lower surface of the weight 200 by the friction element 19. To the positioning platform 13 is attached the tensioner 23 by means of the first set of pulleys 25. The middle section of the tensioner 23 is spanned across the top end of the pile 1, where the pile cover 21 is placed, and is guided through the second set of pulleys 22. The pile actuator assembly 20 further comprises the torsion element 210 positioned between the pile 1 and the pile cover 21. In this preferred embodiment of the pile actuator assembly 20, in the event that the pile 1 needs to be driven in the underwater bed 70, the extenders 28 are slowly contracted allowing the weight 200 to be lowered and push downwards on the positioning platform 13 and tensioners 23, thus, pulling the pile cover 21 and the pile 1 also in a downward direction. In this process, the torsion element 210 allows the floatable body 2 to rotate in the body of water 80 around the pile 1 without interrupting the driving in the underwater bed 70.

The pile guide assembly 10 comprises the pile guide frame 11 attached to the positioning platform 13 and the positioning means 18 configured to push and pull the positioning platform 13 relative to the floatable body 2. To the pile guide frame 11 is connected the pivot 15 with gripper 17 which holds the pile 1. The pile guide assembly 10 is configured to guide the driving direction of the pile 1 while it is pushed in the underwater bed 70 by the pile actuator assembly 20 to achieve the desired verticality.

Figure 10:
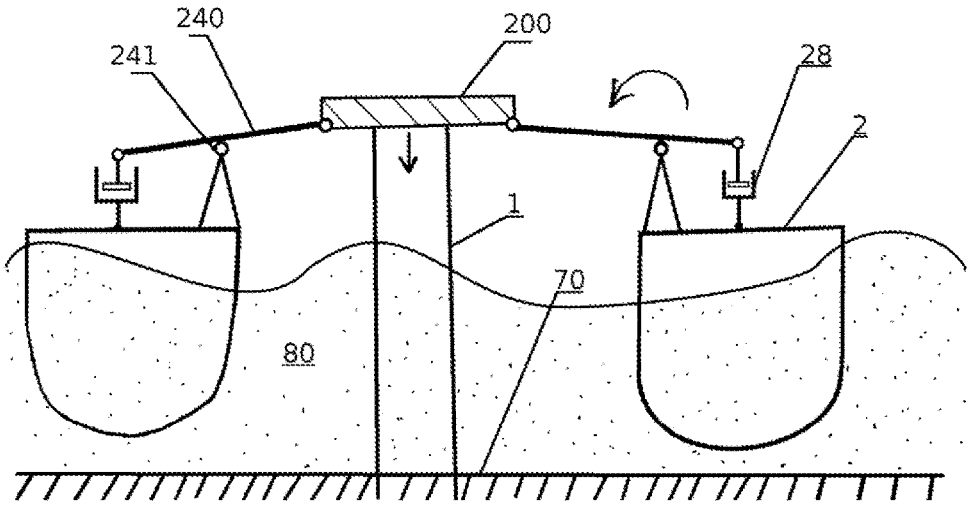
FIG. 10 shows an alternative embodiment of the pile actuator assembly, wherein the pile is driven by a driving lever and a driving pivot.

FIG. 10 shows an alternative embodiment of the pile actuator assembly 20 comprising a driving lever 240 and a driving pivot 241. The floatable body 2 supports the driving pivot 241 around which the driving lever 240 is configured to rotate. One end of the driving lever 240 is connected the extender 28, which is further connected to the floatable body 2, and the other end of the driving lever 240 is connected to the weight 200. The weight 200 is positioned on top of the pile 1 which is placed on the underwater body 70. The extender 28 is configured with sufficient capacity as to be able to push the weight 200 downwards when extending and pivoting the driving lever 240. In this preferred embodiment, the action stroke of the pile driver is during the extension of the extender 28, instead of during compressing as described in the embodiment of FIG. 9. During this action stroke, the extender 28 is required to generate only a limited force, utilized for regulating the speed of driving, whereas the major force component required for driving the pile 1 is provided by the weight 200 itself.

Figure 11A:
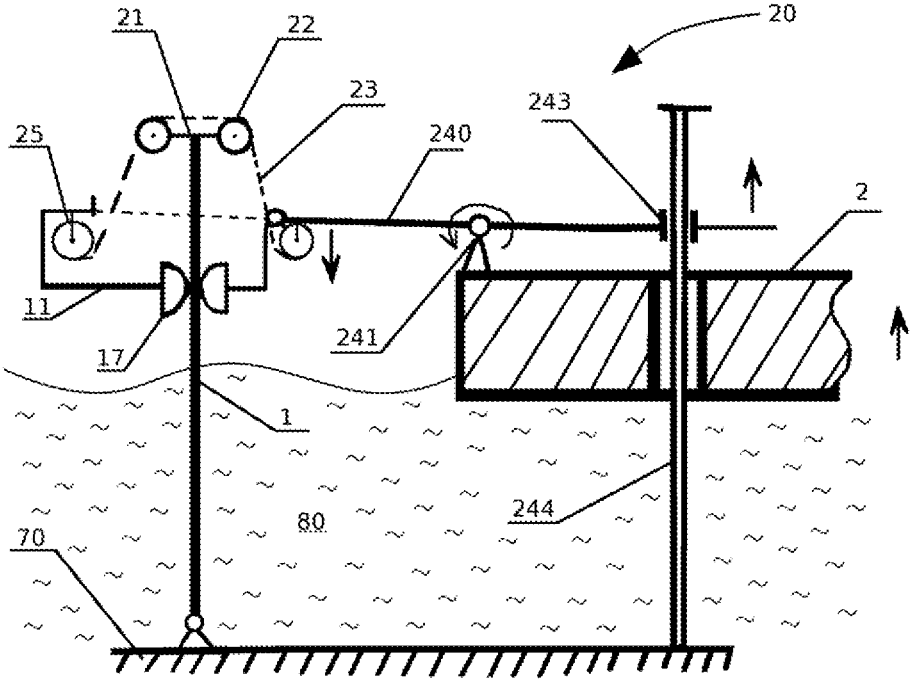
FIGS. 11A and 11B show an alternative embodiment of the pile actuator assembly, according to one embodiment of the disclosure.
Figure 11B:
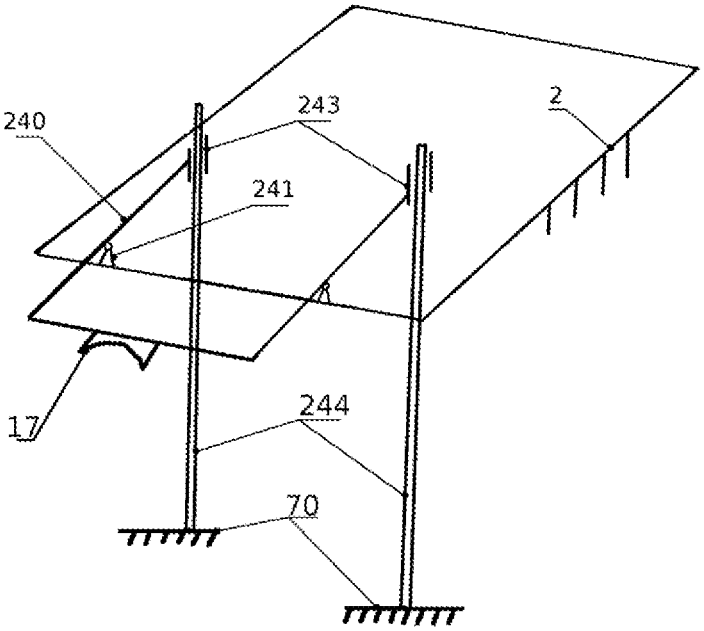

FIGS. 11A and 11B show an alternative embodiment of the pile actuator assembly 20 where the force for driving the pile 1 is created by the vertical movement of the floatable body itself (e.g. jack-up barge). The pile 1 is shown positioned on the underwater bed 70 in the body of water 80 with the floatable body 2 floating on the surface of the body of water 80 next to the pile 1. The floatable body 2 is equipped with legs 244 which are configured to retract and/or extend, lifting the floatable body 2 out of the body of water 80.

The pile actuator assembly 20 comprises the driving pivot 241 positioned on the floatable body 2 and the driving lever 240 configured to pivot on the driving pivot 241. To one end of the driving lever 240 is connected the leg 244 of the floatable body 2 by a leg lock 243. The leg lock 243 is configured to lock and release the connection between the leg 244 and the driving lever 240 whenever required. To the other end of the driving lever 240 is connected the pile guide frame 11. The pile guide frame 11 is equipped with the gripper 17 that holds the pile 1 in a vertical position. To the pile guide frame 11 is attached the first set of pulleys 25. The tensioner 23 is connecting the first set of pulleys 25 to the second set of pulleys 22 which are attached to the pile cover 21 positioned on the top of the pile 1. In this embodiment the pile 1 is driven into the underwater bed 70 when the floatable body 2 is elevated out of the body of water 80 on the legs 244 in the direction of the upwards arrow. The leg lock 243 transfers, that motion to the one end of the driving lever 240 which pivots around the driving pivot 241, pushing the other end of the driving lever 240 downwards in the direction of the downwards arrow. The leg lock 243 can be released and the driving pivot element 240 locked in a lower position repeating the upwards motion. This gradual jacking up of the floatable body 2 results on the controlled driving of the pile 1 into the underwater bed 70, wherein the already existing elements for jacking up the floatable body 2 are used.

Figure 12:
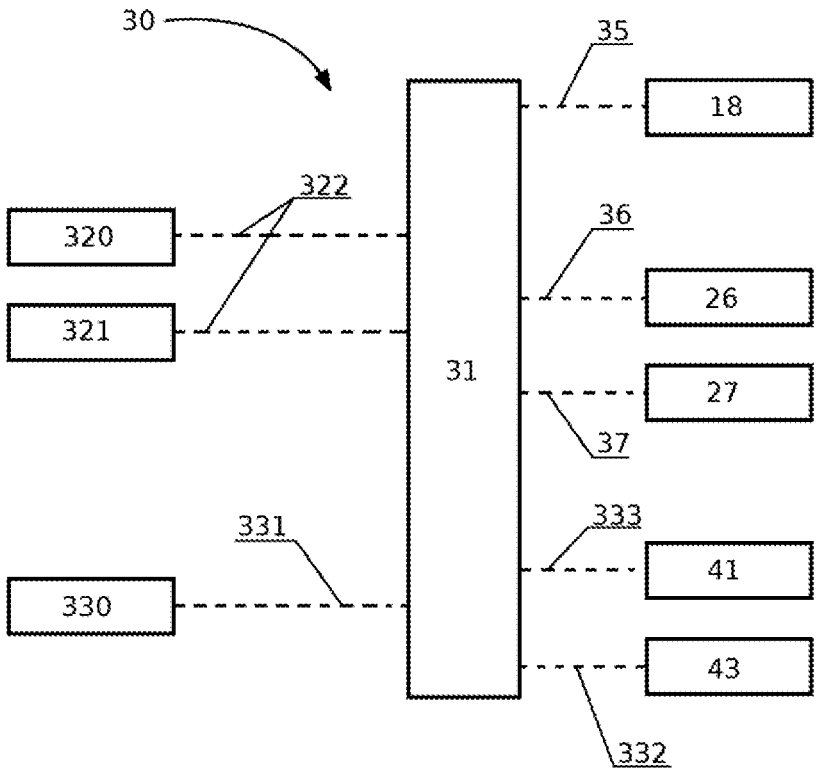
FIG. 12 shows an exemplary pile driving control system, according to one embodiment of the disclosure.

FIG. 12 illustrates an exemplary pile driving control system 30 of the pile driver according to the invention. The pile driving control system 30 comprises a controller 31 and the measurement units for pile position 320, floatable body position 321 and fluid pressure 330. The controller 31 is configured to receive data from and is connected to the floatable body position measurement unit 321 by means of the position data input line 322, to the fluid pressure measurement unit 330 by means of the pressure data input line 331 and to the pile position measurement unit 320 and floatable body position measurement unit 321 by means of the position control line 35. Furthermore, the controller 31 is configured to control and is connected to the pressure relief valve 43 by means of the valve control line 332, to the compressor 41 by the compressor control line 333, to the brake 27 by the brake control line 37, to the force tool 26 by the force control line 36 and to the positioning means 18 by the position control line 35. The control signals sent by the controller 31 may be based on a pre-configured model of operation or they can be based on the data input collected by the controller 31 in real-time.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments. The scope of the invention is therefore defined solely by the following claims.

The invention claimed is:

1. A pile driver, configured to drive a pile into an underwater bed, comprising:

a floatable body with a pile guide configured to guide said pile in a downward direction; and an actuator that is fixed to the floatable body and that is configured to drive the pile from the floatable body into the underwater bed; and a pile booster assembly that comprises at least one of:

a substantially fluid tight seal on said pile; and a compressor configured to pressurize a fluid contained in an inner space of said pile.

2. The pile driver according to claim 1, wherein the actuator is configured to apply a gradual driving force during driving of said pile.

3. The pile driver according to claim 2, wherein the pile guide is displaceable relative to the floatable body.

4. The pile driver according to claim 3, wherein the pile guide comprises a pivot.

5. The pile driver according to claim 1, wherein the actuator comprises an hydraulic extender.

6. The pile driver according to claim 5, wherein the actuator further comprises a weight that is displaceable relative to said floatable body.

7. The pile driver according to claim 1, wherein said pile booster assembly further comprises a pressure relief valve.

8. The pile driver according to claim 1, further comprising a control system.

9. The pile driver according to claim 8, wherein the control system is configured to measure at least one of: a force in the pile driver, an orientation of the pile, an orientation of the floatable body or a fluid pressure in the pile.

10. The pile driver according to claim 8, wherein the control system is configured to control at least one of the actuator, the compressor, a pressure relief valve or a displacement of the pile guide relative to the floatable body.

11. The pile driver according to claim 10, wherein the control system is configured to control at least one of the actuator, the compressor, the pressure relief valve or the displacement of the pile guide relative to the floatable body, based on a measurement of at least one of: a force in the pile driver, an orientation of the pile, an orientation of the floatable body or a fluid pressure in the pile.

12. The pile driver according to claim 1, wherein said pile is a monopile.

13. The pile driver according to claim 1, wherein said floatable body is a ship or a jack-up barge.

14. A pile driver, configured to drive a pile into an underwater bed, comprising:

a floatable body with a pile guide configured to guide said pile in a downward direction; and an actuator that is fixed to the floatable body and that is configured to drive the pile from the floatable body into the underwater bed;

wherein the actuator comprises a pulley assembly:

wherein the pulley assembly comprises a first set of pulleys arranged on said floatable body and a second set of pulleys arranged on said pile; and wherein the pulley assembly comprises a single tensioner.

15. The pile driver according to claim 14, wherein the second set of pulleys is arranged on a pile cover.

16. A method of driving a pile into an underwater bed, comprising the steps of:

positioning a floatable body;

arranging a pile in a pile guide configured to guide said pile in a downward direction; and driving said pile from the floatable body into the underwater bed by an actuator that is fixed to the floatable body;

wherein the step of driving said pile from the floatable body into the underwater bed comprises displacing said pile relative to the floatable body and using at least the weight of said floatable body to drive said pile into the underwater bed.

17. The method according to claim 16, wherein the actuator applies a gradual driving force during driving of said pile.

18. The method according to claim 16, wherein said pile is substantially hollow and the method comprises the step of sealing and pressurizing said pile with a fluid to at least one of: increase the buckling resistance thereof and to reduce soil friction by liquefaction.

19. The method according to claim 18, further comprising a correction step comprising increasing the pressure of said fluid beyond the reaction forces on it to drive the pile backwards, and further comprises the step of correcting the alignment of said pile or the step of a complete decommissioning of said pile.

20. The method according to claim 16, further comprising a control step wherein a control unit measures and controls the driving of said pile.

* * * * *